US010369454B2

(12) United States Patent
Green et al.

(10) Patent No.: US 10,369,454 B2
(45) Date of Patent: Aug. 6, 2019

(54) DRIVE MODULE FOR A SKATEBOARD AND SET AND SKATEBOARD WITH SUCH A DRIVE MODULE

(71) Applicant: Mellow Boards GmbH, Hamburg (DE)

(72) Inventors: Kilian Green, Munich (DE); Christoph Schreiber, Dresden (DE)

(73) Assignee: Mellow Boards GmbH, Hamburg (DE)

( * ) Notice: Subject to any disclaimer, the term of this patent is extended or adjusted under 35 U.S.C. 154(b) by 0 days.

(21) Appl. No.: 15/568,571

(22) PCT Filed: Apr. 20, 2016

(86) PCT No.: PCT/EP2016/058731

§ 371 (c)(1),
(2) Date: Oct. 23, 2017

(87) PCT Pub. No.: WO2016/169969

PCT Pub. Date: Oct. 27, 2016

(65) Prior Publication Data

US 2018/0111038 A1 Apr. 26, 2018

(30) Foreign Application Priority Data

Apr. 23, 2015 (DE) ..... 10 2015 106 255

(51) Int. Cl.
*A63C 17/00* (2006.01)
*A63C 17/01* (2006.01)
(Continued)

(52) U.S. Cl.
CPC ..... *A63C 17/12* (2013.01); *A63C 17/002* (2013.01); *A63C 17/01* (2013.01); *A63C 17/015* (2013.01);
(Continued)

(58) Field of Classification Search
CPC ..... A63C 17/01–17/018
See application file for complete search history.

(56) References Cited

U.S. PATENT DOCUMENTS 5,127,488 A * 7/1992 Shanahan ..... A63C 17/12 180/11
5,330,026 A * 7/1994 Hsu ..... A63C 17/01 180/181
(Continued)

FOREIGN PATENT DOCUMENTS

CH 702661 A2 8/2011
DE 20 2010 004 820 U1 8/2010
(Continued)

OTHER PUBLICATIONS

International Search Report for International Application No. PCT/EP2016/058731, dated Jun. 20, 2016.

*Primary Examiner* — Erez Gurari
(74) *Attorney, Agent, or Firm* — Sterne, Kessler, Goldstein & Fox P.L.L.C.

(57) ABSTRACT

A drive module for a skateboard, the drive module comprising at least one axle with at least one wheel which is or can be driven by an electric motor, and a frame, which is connected to the axle and has a receiving space for an energy storage unit, in particular for a secondary battery, the drive module being replaceably connectible to the skateboard. Also, a set and a skateboard comprising the drive module.

14 Claims, 4 Drawing Sheets

(51) Int. Cl.
*A63C 17/12* (2006.01)
*A63C 17/02* (2006.01)
*A63C 17/22* (2006.01)

(52) U.S. Cl.
CPC ..... *A63C 17/02* (2013.01); *A63C 17/223* (2013.01); *A63C 2203/06* (2013.01); *A63C 2203/12* (2013.01)

(56) References Cited

U.S. PATENT DOCUMENTS

| | | | | |
|---|---|---|---|---|
| 5,893,425 | A * | 4/1999 | Finkle | A63C 17/01 180/180 |
| 7,293,622 | B1 | 11/2007 | Spital | |
| 9,050,540 | B1 * | 6/2015 | Norman | A63H 17/00 |
| D797,227 | S * | 9/2017 | Treadway | D21/765 |
| 2006/0032682 | A1 * | 2/2006 | Hillman | A63C 17/01 180/65.1 |
| 2010/0222941 | A1 * | 9/2010 | Chang | A63C 17/015 701/2 |
| 2013/0206493 | A1 * | 8/2013 | Larson | A63C 17/12 180/181 |
| 2014/0027192 | A1 * | 1/2014 | King | A63C 17/12 180/181 |
| 2015/0297975 | A1 * | 10/2015 | DiCarlo | A63C 17/12 180/180 |
| 2016/0059108 | A1 * | 3/2016 | Demolder | A63C 17/12 701/22 |
| 2016/0256767 | A1 * | 9/2016 | Cerboneschi | A63C 17/01 |
| 2017/0056756 | A1 * | 3/2017 | Pikulski | A63C 17/12 |
| 2017/0144056 | A1 * | 5/2017 | Evans | A63C 17/015 |
| 2018/0104567 | A1 * | 4/2018 | Treadway | A63C 17/265 |
| 2018/0111038 | A1 * | 4/2018 | Green | A63C 17/12 |

FOREIGN PATENT DOCUMENTS

| | | | |
|---|---|---|---|
| DE | 10 2009 036 924 | A1 | 2/2011 |
| EP | 1491243 | A2 | 12/2004 |
| EP | 2 937 122 | A1 | 10/2015 |
| WO | WO 2006/029044 | A2 | 3/2006 |
| WO | 2014108275 | A2 | 7/2014 |

* cited by examiner

DRIVE MODULE FOR A SKATEBOARD AND SET AND SKATEBOARD WITH SUCH A DRIVE MODULE

BACKGROUND OF THE INVENTION

Field of the Invention

The invention relates to a drive module for a skateboard, a set with such a drive module, as well as a skateboard equipped with such a drive module.

Background Art

Already known from prior art, e.g., DE 10 2009 036 924 A1 and WO 2006/029044 A2, are skateboards that have an axle with at least one wheel, wherein the wheel can be electrically driven by an electric motor. Energy is here supplied to the electric motor via an accumulator or batteries, for example which the driver of the skateboard carries with him or her in a backpack. The accumulator to be carried separately limits the comfort of the wearer, and also poses a risk of injury, since a cable connection to the electric motor is required.

As an alternative, prior art proposes that the energy storage unit be integrated into the skateboard. In the fully integrated variant according to WO 2006/029044 A2, the disadvantage is that the skateboard cannot be used while charging the accumulator. As a result, the range of the skateboard is also limited. In addition, the acquisition costs for such a fully integrated skateboard are increased.

BRIEF SUMMARY OF THE INVENTION

The object of the invention is to indicate a concept for an electric drive of a skateboard, which offers a high flexibility to the user, and is easy to handle. The object of the invention is further to indicate a skateboard that realizes this concept.

According to the invention, this object is achieved by a drive module with the features in claim 1, by a set with the features in claim 9, as well as by a skateboard according to claim 12.

The invention proposes a drive module for a skateboard. The drive module can have at least one axle with at least one wheel, wherein the wheel can be or is driven by an electric motor. The drive module can further comprise a frame, which is connected with the axle. The frame has a receiving space for an energy storage unit, in particular an accumulator. The drive module can be replaceably connectible with the skateboard.

The invention is based upon the idea of providing the components for the electric drive of the skateboard as a uniformly manageable module. In particular, the uniformly manageable drive module can be universally used for a plurality of skateboards, in particular the boards (decks) of skateboards. This gives the user an opportunity to retrofit or convert his or her already existing skateboard with an electric drive. In addition, the drive module can also be combined with different skateboards or decks of skateboards on the production side already.

The drive module essentially allows a standardization, so that a plurality of different skateboards, in particular also longboards or slalom boards, can be equipped with the uniform drive module. This also applies to conventional or commercially available, non-driven skateboards, which can be easily retrofitted with the invention.

The ability to replace the drive module also makes it possible to use the electric drive in different, already existing or conventional skateboards. At any time, the user can thus choose which of his or her existing skateboards he or she wants to equip with the drive module.

Another advantage to the invention is that the energy storage unit of the drive module can be replaced. This largely eliminates the range limitations placed on electrically driven skateboards from prior art. This is because the replaceable energy storage unit makes it possible to replace a spent energy storage unit with a charged energy storage unit in just a few hand movements, so that the drive module remains ready for operation. The removed, spent energy storage unit can then be charged independently of the drive module. In addition, the ability to replace the energy storage unit makes it possible to offer the user different energy storage units, for example with different energy storage capacities.

The frame of the drive module preferably forms a supporting structure that carries all components of the drive module. It is essentially advantageously provided that all components required for an electric drive be combined in the drive module. As a consequence, the drive module forms a compact unit that is only connected with a skateboard, in particular the deck of a skateboard, so as to equip the skateboard with an electric drive. The drive module can here be operated via remote control, in particular wireless remote control. Remote control of the drive module can also be realized with a mobile phone, in particular a smartphone, which contains a corresponding software.

The frame can have several functions. On the one hand, the frame can ensure that individual components of the drive module are protected against damage. Furthermore, the frame, which borders the receiving space for the energy storage unit, can form a guide for the energy storage unit, so that the energy storage unit can be easily arranged in the drive module. Finally, the frame can form a heat sink, in particular if the frame is made out of a metal, for example aluminum. This enables a heat dissipation from components situated inside of the frame, for example from power electronic components or the energy storage unit. In addition, the frame functions as a design element.

In a preferred embodiment of the drive module according to the invention, the frame comprises a base plate for the axle, and is detachably connectible with a deck of the skateboard. Therefore, the frame essentially combines all load-bearing components of the drive module, thereby yielding an especially compact unit. It can here be provided that the frame, in particular the base plate, has a standardized hole pattern to be connected with the deck.

As a rule, the decks of skateboards have a standardized hole pattern usually consisting of six holes. The spacing and arrangement of holes are essentially identical for all deck manufacturers, since agreement has here been reached on a standard. If the frame, in particular the base plate, preferably also has this hole pattern in the drive module according to the invention, the drive module can be secured to any decks for skateboards, regardless of any specific manufacturer. This increases the possible uses for the drive module, and simplifies assembly of the drive module to a skateboard.

In particular, the hole pattern can have six holes or bores, wherein two holes form a respective hole pair. The distance between the two holes of each hole pair usually measures 41.3 mm (1.625 inches).

The hole pairs are arranged in a row, wherein the distance between the hole pairs varies. In particular, a front hole pair, a middle hole pair and a rear hole pair can be provided. The middle hole pair is preferably spaced further apart from the rear hole pair than from the front hole pair. The terms "front" and "rear" here refer to the traveling direction of the skateboard with the mounted base plate. In particular, the rear hole pair is located closer to the receiving space for the energy storage unit than the middle and/or front hole pair. In particular, the front hole pair and middle hole pair can be arranged in front of the axle, and the rear hole pair in back of the axle.

The distance between the rear hole pair and middle hole pair preferably measures 54 mm (2.125 inches). The rear hole pair can be spaced apart from the front hole pair by 63.5 mm (2.5 inches). The hole distance between the holes of the first and rear hole pairs is suitable for assembling the base plate or drive module onto a deck having a so-called "old school" bore pattern. By contrast, the hole distance between the holes of the front and middle hole pair is suitable for assembling the base plate or drive module onto a deck having a so-called "new school" bore pattern.

The frame can further have a support plate, which can be connected with a skateboard deck independently of and/or spaced apart from the base plate. The support plate increases the stability of the drive module in the assembled state. The support plate can here be adjusted to the contour of the skateboard deck or carry a damping layer, which is pressed against the contour of the skateboard deck. For example, the damping layer can consist of rubber or sponge rubber.

For connection with the skateboard deck, the frame preferably has a positive-locking element, in particular a keyhole opening. The positive-locking element is preferably formed in the support plate. Using the positive-locking element enables a particularly stable and simple attachment of the drive module to a skateboard deck. The positive-locking element can here serve to initially fix the drive module in place. In this way, the user can positively connect the drive module with the deck, and then fix it in place with a screw connection through the hole pattern of the base plate. This simplifies assembly, while simultaneously ensuring a good and reliable attachment of the drive module to the skateboard deck.

A preferred variant of the drive module provides that the frame form at least one protective bracket, which connects the support plate with the base plate. The support plate and base plate can essentially be arranged on the same plane. In the assembled state, both plates, the support plate and base plate, are joined with a skateboard deck. The protective bracket joins the support plate with the base plate, wherein the protective bracket can be spaced apart from the skateboard deck. As a result, the protective bracket can be used as an impact guard for additional components of the drive module. In addition, the frame uses the protective bracket to essentially form a cage, so that all components of the drive module are reliably held inside of the frame.

The electric motor of the drive module can be connected with a controller located inside of the frame. The controller can preferably be electrically connected with the energy storage unit. The controller can essentially comprise power electronics that regulate the power of the electric motor. The power electronics can be arranged on a uniform plane. Because the controller is arranged inside of the frame, the frame protects the controller.

The controller can be arranged in a controller housing, wherein the frame, in particular the protective bracket, at least partially envelops the controller housing. The frame can essentially form a cage, which extends around the controller housing, and thereby protects the controller housing against shocks, impacts or falling rocks. The controller housing itself can be made out of plastic or a metal, in particular aluminum. When using a metal, the controller housing provides additional impact resistance on the one hand, and dissipates heat on the other. The controller housing is preferably rigidly connected with the frame.

In a preferred embodiment of the invention, the controller housing has a plug contact for electrically connecting the energy storage unit with the controller. The plug contact can be designed as a plug or bushing. In any event, the plug contact is preferably designed so as to easily enable an electrical connection between the controller and energy storage unit by inserting the energy storage unit into a guide preferably formed in the receiving space for the energy storage unit. In this way, the electrical connection between the energy storage unit and controller can be established with a single hand movement. The plug contact can be multipolar in design, and have both power contacts and data contacts. The interface between the controller and energy storage unit preferably enables data transmission, as well as an electrical connection to the power supply. For example, the controller consists of power electronics, battery management electronics, as well as a wireless communications unit. The wireless communications unit permits wireless communication with a remote control, for example via Bluetooth, in particular Bluetooth LE, Zigbee or WLAN.

Another preferred embodiment of the invention provides that the frame and/or controller housing have a latching mechanism for fixing the replaceable energy storage unit in place. The latching mechanism makes it possible to easily and quickly replace the energy storage unit. In particular, the energy storage unit can be removed or inserted with a single hand movement. The energy storage unit is here connected firmly enough with the drive module, and an electrical connection is simultaneously established with the controller. As a result, the energy storage unit can be replaced without any tools.

The drive module is preferably configured so that it can remain on a skateboard deck in an assembled state while replacing the energy storage unit. Therefore, replacing the energy storage unit does not require that the entire drive module be disassembled, but can rather be done with the drive module in the assembled state. This makes it even easier to handle the entire drive module.

To economize on weight, it can be provided that the energy storage unit have a housing made out of plastic. The plastic housing can integrate latching elements on the energy storage unit that interact with the latching mechanism on the frame and/or on the controller housing.

It can further be provided that the axle have an axle carrier, wherein a cable duct is formed in the axle carrier. The axle carrier is preferably hinged with the base plate. The axle carrier is also known as a hanger in technical jargon. The hanger is preferably hinged with the base plate of the frame, so that the user can change the traveling direction by shifting his or her weight in the driving mode. To provide for the supply of power to the electric motor, it makes sense to have a cable connection between the controller and electric motor. It can here be provided in particular that the electric motor be configured as a wheel hub motor. As a consequence, the electric motor sits directly on the axle or an axle bolt of the axle. The electric motor can here have a variable running surface, so that the electric motor itself essentially comprises the wheel of the drive module. The cable duct formed in the hanger or axle carrier serves to protect the cable connection between the electric motor and controller.

The present invention further relates to a set with a drive module described above and a retaining bolt. On the one hand, the retaining bolt can be fixedly connectible with a skateboard deck. On the other hand, the retaining bolt can be positively connectible with the frame of the drive module so that it can be unlatched. The set thus includes all components for using the drive module on any skateboard deck. In this way, the user can simply retrofit an existing skateboard with an electric drive module. On the one hand, the connection with the deck of the already existing skateboard is established via the standardized six-hole pattern with which the frame, in particular the base plate, of the drive module is fixed to the deck. To ensure an adequate stability, the set further comprises the retaining bolt, which is rigidly secured to the deck on the one hand, and positively engages in the frame on the other, so as to yield another fixing point for the drive module. The retaining bolt can here be connected with the skateboard deck with screws or adhesive.

The set can further have a replaceable energy storage unit, in particular an accumulator. The energy storage unit is preferably adjusted in such a way that it is or can be arranged in the receiving space of the frame of the drive module.

Another aspect of the invention relates to a skateboard with a deck and a previously described drive module. The drive module is preferably connected with the deck.

BRIEF DESCRIPTION OF THE DRAWINGS/FIGURES

The invention will be described in greater detail below based on an exemplary embodiment, with reference to the attached, schematic drawings. Shown therein on:

DETAILED DESCRIPTION OF THE INVENTION

Figure 1:
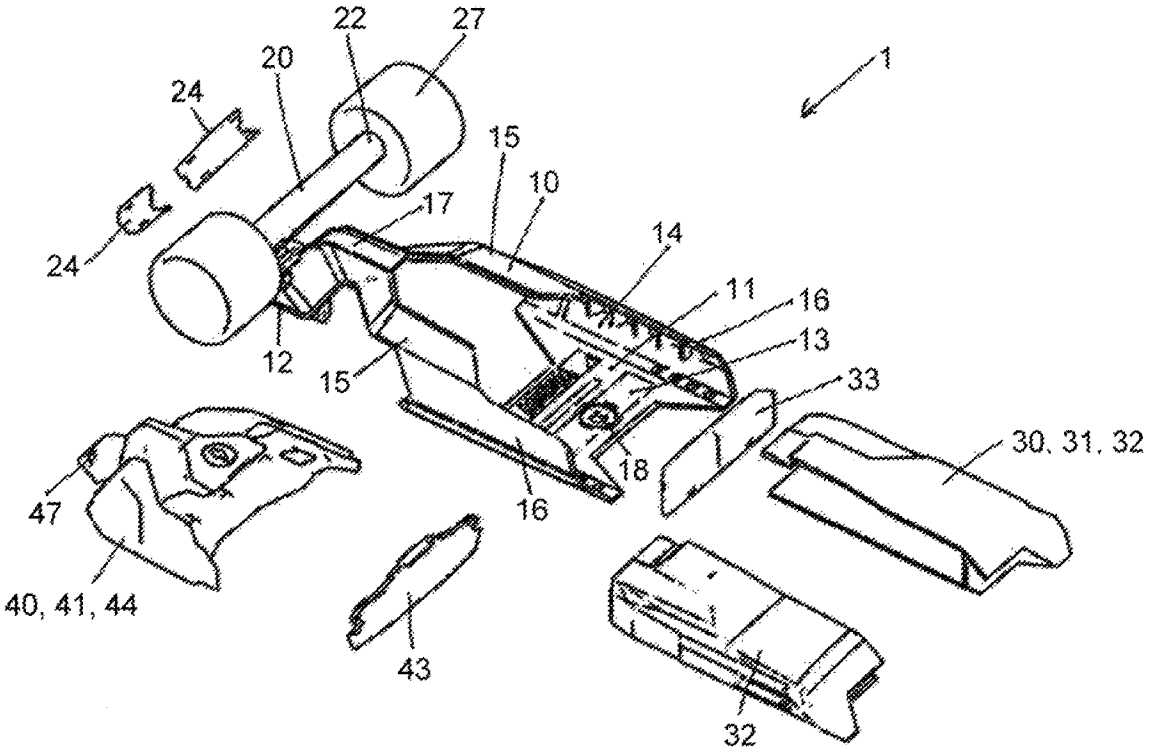
FIG. 1 is a perspective exploded view of a drive module according to the invention in a preferred exemplary embodiment.

FIG. 1 shows the essential components of the drive module according to the invention in a preferred configuration. The drive module 1 for a skateboard consists of a frame 10 that borders a receiving space 11. An energy storage unit 30 can be inserted into the receiving space 11. The energy storage unit 30 is designed as an accumulator or rechargeable battery pack. The energy storage unit 30 can alternatively also be designed as a battery. The frame 10 is connected with an axle 20, which carries two wheels 27. The connection between the axle 20 and frame 10 is preferably hinged.

FIG. 1 further shows a controller 40, in particular a controller housing 41. The controller housing 41 is comprised of a housing body 44 that can be sealed by a back plate 43. Power electronics 42 are preferably located inside of the controller housing 41. The back plate 43 has a bushing 45, which enables electrical contact between the controller 40 and energy storage unit 30.

The frame 10 has a base plate 12 and a support plate 13. The base plate 12 and support plate 13 are joined together by two protective brackets 15. Specifically, lateral side profiles 16 extend from the support plate 13, and pass over into the protective brackets 15. The side profiles 16 form a guide 14 for the energy storage unit 30, so that the latter can be inserted into the frame 10. A frame neck 17 designed as a double-headed connecting profile extends between the base plate 12 and protective brackets 15. The protective brackets 15 essentially pass over into the shared frame neck 17.

Figure 6:
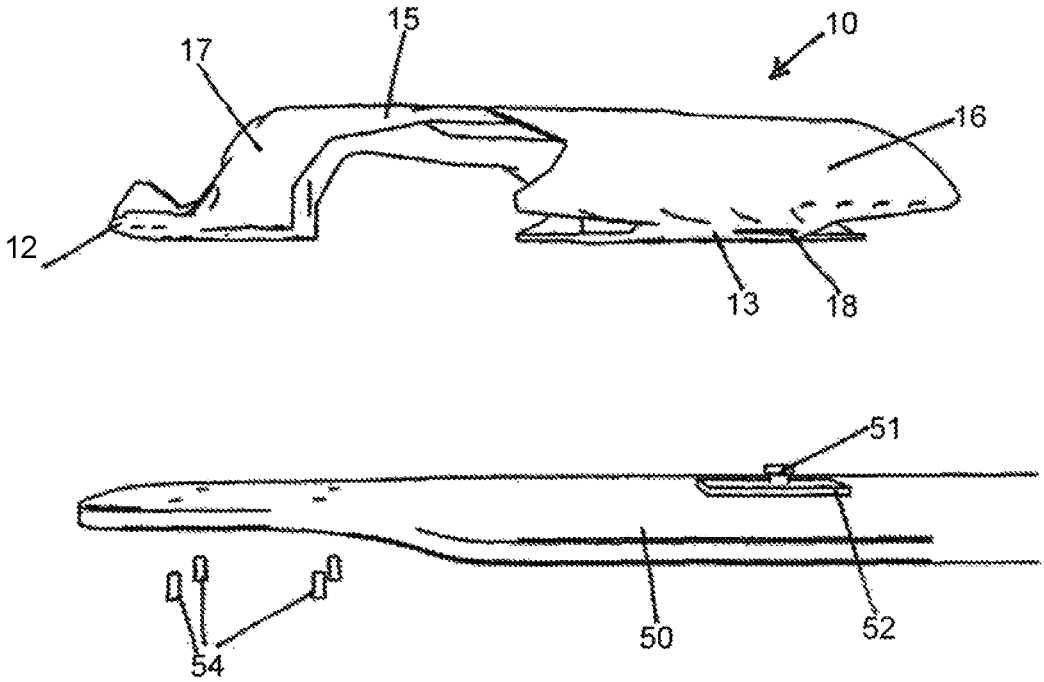
FIG. 6 is an exploded view with a frame of the drive module according to FIG. 1 and a skateboard deck.

As especially readily discernible on FIG. 6, the base plate 12 and support plate 13 are arranged in a shared plane. The frame neck 17 extends from this plane, and connects the base plate 12 with the protective brackets 15, which are spaced apart from the shared plane of the base plate 12 and support plate 13. The protective brackets 15 extend essentially parallel to this shared plane. The frame neck 17 together with the protective brackets 15 essentially yields a Y-profile as viewed from above.

In the assembled state, the controller 40, in particular the controller housing 41, is located inside of the frame 10. The controller housing 41 is rigidly connected with the frame 10. The controller housing 41 here extends under the protective brackets 15. In other words, the controller housing 41 is enveloped by the protective brackets 15. As a consequence, the protective brackets 15 yield an impact guard for the controller housing 41 or controller 40. At the same time, at least sections of the side profiles 16 can extend over the controller housing 41, thereby ensuring a lateral impact guard for the controller housing 41 as well.

The side profiles 16 are connected with each other by the support plate 13. A positive-locking element 18 is formed in the support plate 13, preferably in the form of a keyhole opening. The positive-locking element 18 serves to fix the drive module 1 in place on a skateboard deck 50.

The energy storage unit 30 shown on FIG. 1 is essentially designed as an accumulator or battery. To this end, the energy storage unit 30 has a battery housing 31, which is composed of two side parts 32 and a front plate 33. The side parts 32 and front plate 33 are preferably made out of plastic. The outer contour of the battery housing 31 essentially corresponds to the inner profile of the receiving space 11 in the frame 10, so that the battery housing 31 can be inserted into the receiving space 11, in particular along the guide 14, and there positively fixed in place.

Figure 2:
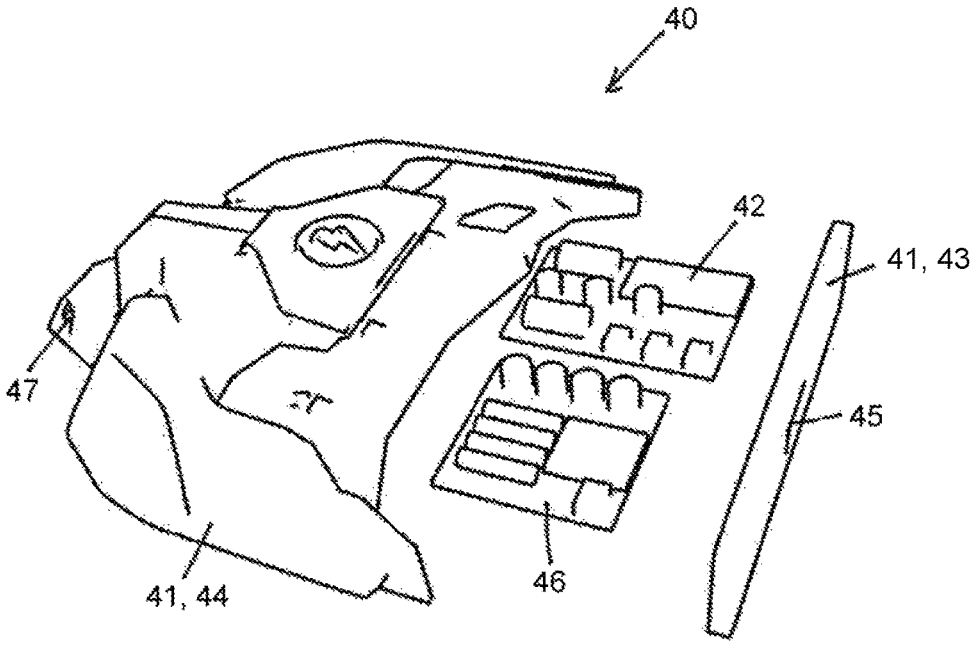
FIG. 2 is a perspective exploded view of a controller housing of the drive module according to FIG. 1.

FIG. 2 shows the structural design of the controller 40 in detail. The controller 40 essentially comprises the controller housing 41 with the housing body 44 and back plate 43. Power electronics 42 are located inside of the controller housing 41. A radio communication unit 46 is further provided in the depicted exemplary embodiment. A bushing 45 is formed in the back plate 43 for establishing an electrical and data connection between the controller 40 and energy storage unit 30. The bushing 45 is preferably configured in such a way that an electrical connection can be established between the controller 40 and energy storage unit 30 by simply inserting the energy storage unit 30 into the receiving space 11. The controller housing 41, in particular the housing body 44, further comprises a cable outlet 47, which enables the cable connection between the controller 40 and an electric motor of the drive module 1. The cable outlet 47 is preferably situated close to the axle.

Figure 3:
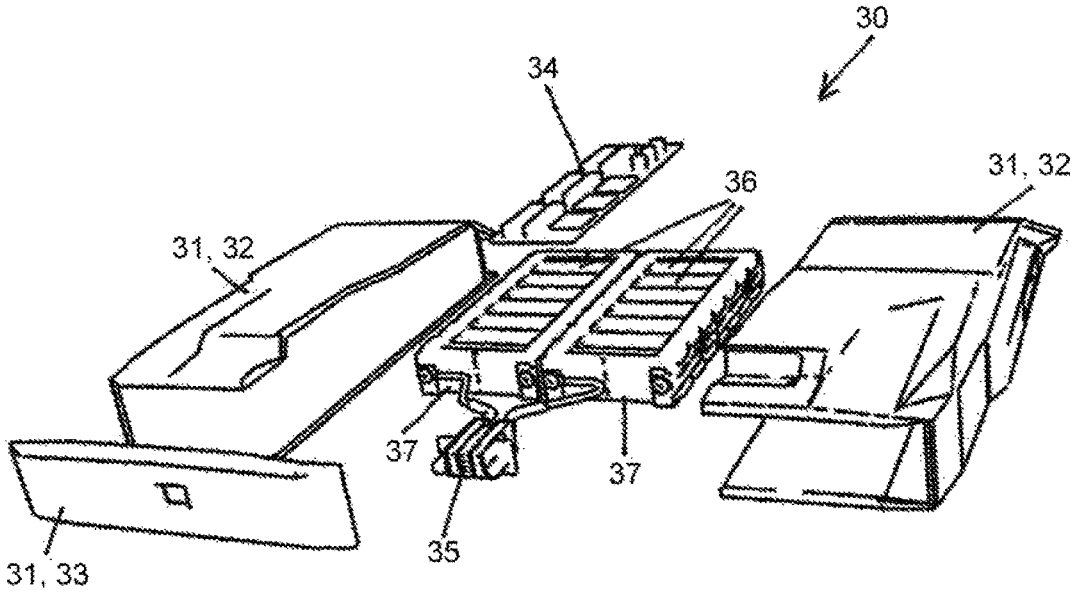
FIG. 3 is a perspective exploded view of an energy storage unit of the drive module according to FIG. 1.

FIG. 3 shows the structural design of the energy storage unit 30 in detail. The energy storage unit 30 consists of the battery housing 31 with the side parts and front plate 33. Several cells, in particular battery cells or accumulator cells, are preferably arranged inside of the battery housing 31.

Several cells 36 are here wired together into cell blocks 37. The cell blocks 37 are electrically connected with a plug 35, which is situated on the back plate 43. The plug 35 is preferably aligned in such a way as to engage into the bushing 45 of the controller 40 while inserting the energy storage unit 30 into the receiving space 11, and thereby establish an electrical connection. Battery management electronics 34 are also arranged inside of the battery housing 31. The battery management electronics 34 control the charging and discharging process of the energy storage unit 30. In addition, the battery management electronics 34 provide a signal connection to the power electronics 42 of the controller 40, so that state data for the energy storage unit 30 can be retrieved via the power electronics 42. In addition, the data connection between the battery management electronics 34 and controller 40 can be transmitted via the radio communication unit 46 to a display device that can be wirelessly connected with the drive module 1, for example a remote control and/or a smartphone.

Figure 4:
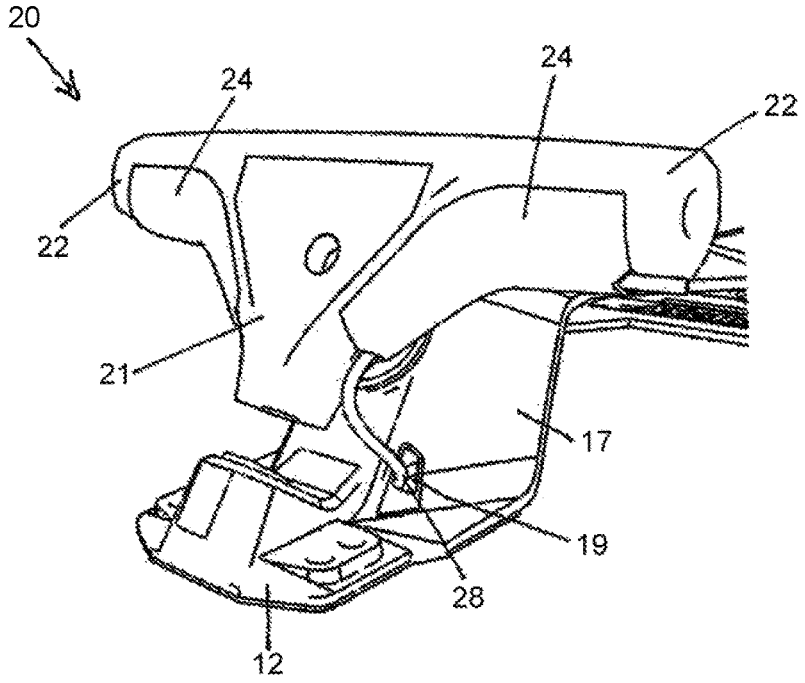
FIG. 4 is a perspective view of the axle of the drive module according to FIG. 1 with covered cable duct.
Figure 5:
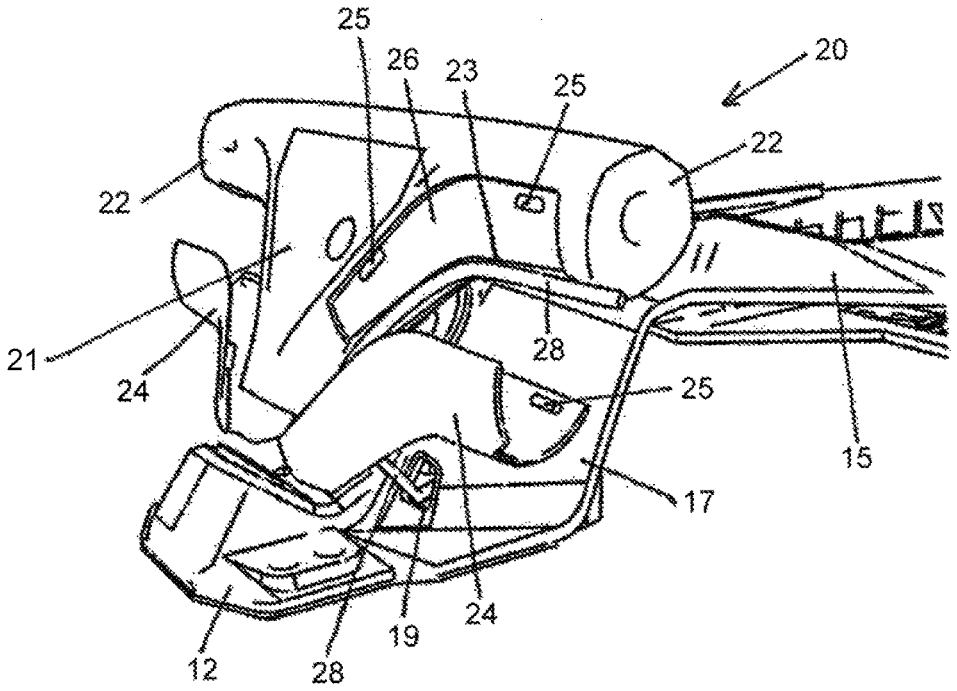
FIG. 5 is a perspective view of the axle according to FIG. 4 with open cable duct.

FIGS. 4 and 5 show an axle 20 of the drive module 1. The axle 20 consists of an axle carrier 21, which is also referred to as a hanger in technical jargon. Axle bolts 22 are molded onto the axle carrier 21. The geometry of the axle 20 essentially corresponds to the geometry of known skateboard axles. The axle carrier 21 has a cable duct 23, which essentially extends from the axle bolt 22 until close to a hinged connection between the axle carrier and base plate 12. The hinged connection itself is not shown on FIGS. 4 and 5 for reasons of clarity.

A cable 28 is arranged in the cable duct 23, and extends from an electric motor along the cable duct 23 up until the frame neck 17. To this end, a cable bushing 19 is formed in the frame neck 17, so that the cable 28 is largely protected while being guided up until the controller 40. The cable duct 23 minimizes the distance covered by the cable 28 unprotected. A duct cover 24 that can be latched with the axle carrier 21 also serves this purpose. The axle carrier 21 has recesses 26 in which latching elements 25 are arranged. Corresponding latching elements 25 are also arranged in the cable cover 24, so that the cable cover 24 can be placed in the recess 26. The depth of the recess 26 is here preferably adjusted to the wall thickness of the cable cover 24.

As denoted on FIGS. 4 and 5, the axle carrier 21 preferably carries a respective cable duct 23 on either side, which leads to a respective one of the axle bolts 22 of the axle 20. Accordingly, two recesses 26 along with two duct covers 24 are provided. The drive module 1 is preferably equipped with two electric motors designed as wheel hub motors. Therefore, the axle bolts 22 each directly carry an electric motor, wherein the electric motor has an outer running surface. The electric motor here essentially serves as a wheel 27 of the drive module 1. The electric motors can preferably be actuated separately, which yields a high flexibility in various driving situations.

Figure 7:
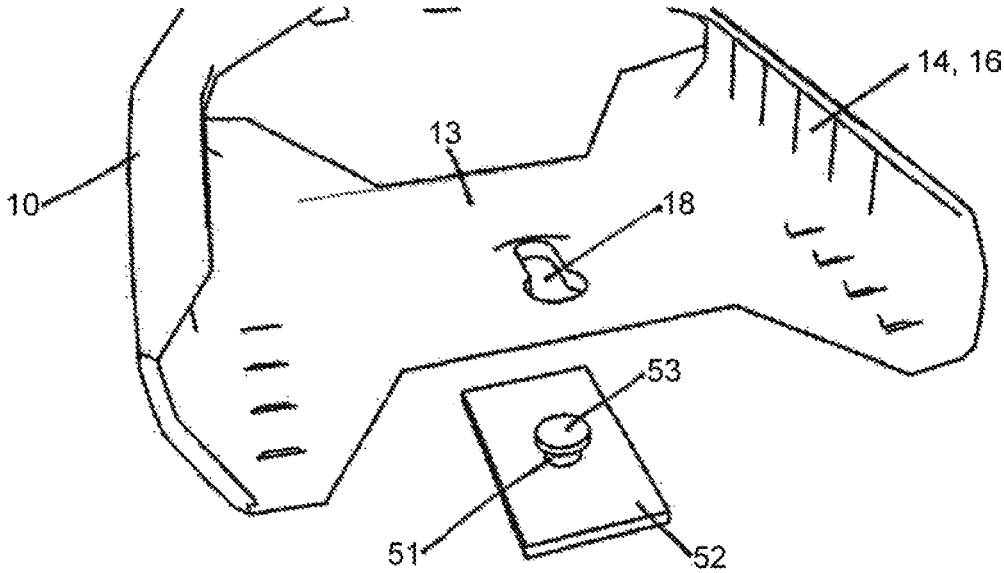
FIG. 7 is a detailed view of the frame according to FIG. 6 and a retaining bolt for connection with the frame.

FIGS. 6 and 7 exemplarily illustrates the connection of the drive module to a skateboard deck 50. The frame 10 of the drive module 1 essentially serves as a link between the drive module 1 and deck 50. To this end, use is made on the one hand of the standardized hole pattern in the deck 50, which usually consists of six holes. The base plate 12 comprises a corresponding number of bores, in particular at least four bores, so that the frame 10 on the base plate 12 can be connected with the deck 50 using screws 54. In order to stabilize the connection, the positive-locking element 18 is further preferably formed on the frame 10, wherein the positive-locking element 18 is spaced apart from the base plate 12. The positive-locking element 18 preferably consists of a keyhole opening, which is formed on the support plate 13.

Most of the time, no corresponding counter-element is provided at the location of the positive-locking element 18 in conventional skateboard decks 50. In this regard, it is advantageous to offer the connecting module 1 in a set with a retaining bolt 51, wherein the retaining bolt can be connected with the deck 50. The retaining bolt can here be connected with the deck 50 via a screwed connection or, as in the exemplary embodiment shown, via an adhesive bond.

To achieve an adequate adhesive bond, the retaining bolt 51 preferably has an adhesive plate 52 that provides an enlarged adhesive surface. The size of the adhesive plate 52 is dimensioned so as to ensure a strong enough connection between the retaining bolt 51 and deck 50. The retaining bolt 51 is connected with the frame 10 by means of the positive-locking element 18 in the form of a keyhole opening, which is readily discernible on FIG. 7. To ensure a positive connection not just in the horizontal, but also in the vertical direction, the retaining bolt 51 has a bolt head 53, which in the assembled state engages the positive-locking element 18 or an oblong hole section of the keyhole opening from behind.

The drive module 1 preferably together with an energy storage unit 30 has a mass of less than 4 kg, in particular less than 3 kg. It is further preferably provided that the entire drive module 1 including the energy storage unit 30 essentially be liquid-tight in design. To this end, it can be provided in particular that a seal be arranged between the energy storage unit 30 and controller 40. The seal is preferably fixedly secured to the back plate 43 of the controller housing 41.

The entire drive module 1, in particular to include the energy storage unit 30, is preferably designed so that it can achieve speeds in excess of 20 km/h. With respect to the wheels 27 with the electric motor designed as a wheel hub motor, it is preferably provided that the latter have an outer diameter of at most 80 mm. The wheels 27 can be driven by the electric motor in the form of an electric direct drive. The electric motor and the controller 40, in particular the power electronics 42, can be configured so that the electric motor acts as a regenerative brake.

With respect to the energy storage unit 30, it is preferably provided that the latter consist of an accumulator or battery having an integrated battery management system. The accumulator preferably has an energy content of about 100 Wh. The drive module 1 can be nominally operated with a d.c. voltage of 24 volts. The accumulator can here consist of two cell blocks 37 with a total of 14 cells. The cells 36 are preferably designed as lithium-ion cells.

It can further be provided that the energy storage unit 30, in particular the battery housing 31, have a display that furnishes information about the charging state of the cells 36. For example, the display can be made up of a series of LED's. The charging state query can be initiated by pressing a button, wherein a corresponding actuator button is provided on the battery housing 31. The battery management electronics 34 are here coupled with the display in such a way as to also enable a charging state display when the energy storage unit 30 is decoupled from the controller 40. The energy storage unit 30, in particular the battery management electronics 34, is preferably configured in such a way that the cells 36 can be charged both while installed inside of the drive module 1 and independently of the drive module 1.

REFERENCE LIST

1 Drive module
10 Frame
11 Receiving space
12 Base plate
13 Support plate
14 Guide
15 Protective bracket
16 Side profile
17 Frame neck
18 Positive-locking element
19 Cable bushing
20 Axle
21 Axle carrier
22 Axle bolt
23 Cable duct
24 Duct cover
25 Latching element
26 Recess
27 Wheel
28 Cable
30 Energy storage unit
31 Battery housing
32 Side part
33 Front plate
34 Battery management electronics
35 Plug
36 Cell
37 Cell block
40 Controller
41 Controller housing
42 Power electronics
43 Back plate
44 Housing body
45 Bushing
46 Radio communications unit
47 Cable outlet
50 Deck
51 Retaining bolt
52 Adhesive plate
53 Bolt head
54 Screw

What is claimed is:

1. A drive module for a skateboard, the drive module comprising:

an axle with at least one wheel, which is configured to be driven by an electric motor, and a frame, which is connected with the axle, and has a receiving space for an energy storage unit, wherein the drive module is configured to be replaceably connectible with the skateboard, wherein the electric motor is connected with a controller, which is configured to be electrically connected with the energy storage unit, wherein the frame forms at least one protective bracket, wherein the frame, in particular the at least one protective bracket, at least partially envelops the controller housing, and wherein the controller housing has a plug contact for electrically connecting the energy storage unit with the controller.

2. The drive module according to claim 1, wherein the frame comprises a base plate for the axle, and is detachably connectible with a deck of the skateboard.

3. The drive module according to claim 2, wherein the frame has a support plate, which is configured to be connected with the deck of the skateboard independently of and spaced apart from the base plate.

4. The drive module according to claim 3, wherein the frame has a positive-locking element, in particular a keyhole opening, which is formed in the support plate.

5. The drive module according to claim 3, wherein the at least one protective bracket connects the support plate with the base plate.

6. The drive module according to claim 1, wherein the frame has a latching mechanism for fixing the replaceable energy storage unit in place.

7. The drive module according to claim 2, wherein the axle has an axle carrier, which in particular is hinged with the base plate, wherein a cable duct is formed in the axle carrier.

8. The drive module according to claim 1, wherein the electric motor comprises a wheel hub motor.

9. A set comprising:

a drive module according to claim 1; and a retaining bolt, wherein the retaining bolt is fixedly connectible with a skateboard deck and is connectible with the frame of the drive module so that the drive module is configured to be unlatched from the skateboard deck.

10. The set according to claim 9, wherein the retaining bolt is configured to be connected with the skateboard deck with screws or adhesive.

11. The set according to claim 9, further comprising a replaceable energy storage unit, which is configured to be arranged in the receiving space of the frame of the drive module.

12. A skateboard comprising:

a deck; and a drive module according to claim 1, which is connected with the deck.

13. The drive module according to claim 1, wherein the controller housing has a latching mechanism for fixing the replaceable energy storage unit in place.

14. The drive module according to claim 1, wherein the energy storage unit comprises an accumulator.

* * * * *